US008613145B2

(12) United States Patent
Poole et al.

(10) Patent No.: US 8,613,145 B2
(45) Date of Patent: Dec. 24, 2013

(54) CUTTING TOOL WITH DOUBLE COMPOUND LEVERAGE

(76) Inventors: Robert N. Poole, Scottsdale, AZ (US); Daniel Poole, Glendale, AZ (US)

( * ) Notice: Subject to any disclaimer, the term of this patent is extended or adjusted under 35 U.S.C. 154(b) by 507 days.

(21) Appl. No.: 12/880,857

(22) Filed: Sep. 13, 2010

(65) Prior Publication Data

US 2011/0083327 A1 Apr. 14, 2011

Related U.S. Application Data

(60) Provisional application No. 61/242,547, filed on Sep. 15, 2009.

(51) Int. Cl.
*B26B 17/02* (2006.01)

(52) U.S. Cl.
USPC ..... 30/192; 30/191; 30/193

(58) Field of Classification Search
USPC ..... 30/191, 192, 249, 250, 251, 193; 72/409.11, 409.12
See application file for complete search history.

(56) References Cited

U.S. PATENT DOCUMENTS

| | | | | | |
|---|---|---|---|---|---|
| 146,829 | A | * | 1/1874 | Lindsay | 81/351 |
| 720,835 | A | * | 2/1903 | Moore | 30/193 |
| 832,804 | A | * | 10/1906 | Oneal | 30/193 |
| 914,910 | A | * | 3/1909 | Alley | 30/191 |
| 1,076,667 | A | * | 10/1913 | Farrington | 30/191 |
| 1,179,220 | A | * | 4/1916 | Roberts | 30/193 |
| D50,029 | S | * | 12/1916 | Porter | D8/58 |
| 1,247,716 | A | * | 11/1917 | Porter | 30/193 |
| 1,254,284 | A | * | 1/1918 | Southwood | 30/252 |
| 1,572,787 | A | * | 2/1926 | Glee et al. | 30/252 |
| 1,586,297 | A | * | 5/1926 | Du Bois | 72/387 |
| 1,760,627 | A | * | 5/1930 | Bernard | 30/192 |
| 1,860,290 | A | * | 5/1932 | Lebherz | 7/133 |
| 2,577,638 | A | * | 12/1951 | Tibbetts | 30/193 |
| 3,084,575 | A | * | 4/1963 | Klein | 72/409.11 |
| 3,182,485 | A | * | 5/1965 | Sund | 72/409.11 |
| 3,704,620 | A | * | 12/1972 | Allen | 72/409.01 |
| 4,505,038 | A | * | 3/1985 | Porter | 30/193 |
| 5,898,998 | A | * | 5/1999 | Deville | 30/193 |
| D436,815 | S | * | 1/2001 | Yang | D8/52 |
| 6,226,874 | B1 | * | 5/2001 | Jansson | 30/192 |
| 7,346,991 | B1 | * | 3/2008 | Janson | 30/244 |
| 7,444,851 | B1 | * | 11/2008 | Janson | 72/409.12 |
| 2011/0083327 | A1 | * | 4/2011 | Poole et al. | 30/192 |

* cited by examiner

*Primary Examiner* — Hwei C Payer
(74) *Attorney, Agent, or Firm* — Parsons & Goltry; Robert A. Parsons; Michael W. Goltry

(57) ABSTRACT

A cutting tool with double compound leverage includes first and second opposed handle levers having handle ends and pivot ends. One of the handle levers includes a double link with a rearward portion defining the handle end and a forward portion defining the pivot end. First and second opposed blade levers each include a jaw end with a cutting blade and a lever end. The blade levers are each pivotally attached intermediate the jaw end and the lever end at spaced apart pivot points to a transverse coupling element. The pivot ends of the handle levers are pivotally attached to the lever ends of the blade levers. First and second compound linkage pivotally couple the handle levers and the blade levers so as to provide complete opening and closing of the cutting jaws.

24 Claims, 6 Drawing Sheets

CUTTING TOOL WITH DOUBLE COMPOUND LEVERAGE

CROSS-REFERENCE TO RELATED APPLICATIONS

This application claims the benefit of U.S. Provisional Application No. 61/242,547, filed 15 Sep. 2009.

FIELD OF THE INVENTION

This invention relates to cutting devices.

More particularly, the present invention relates to cutting devices using compound leverage.

BACKGROUND OF THE INVENTION

Double compound cutting tools are known in the art, such as those disclosed in U.S. Pat. No. 7,346,991 and U.S. Pat. No. 7,444,851 incorporated by reference herein. In each of these prior art devices the cutting jaws are pivotally attached adjacent a rear end by a single pivot pin.

In some compound cutting tools the rear ends of the cutting jaws are attached at spaced apart pivot points by a transverse coupling element to provide increased power to the cutting jaws. However, previous attempts at forming double compound cutting tools having transverse coupling elements forming separate, spaced apart pivots points have had operating problems. Specifically, the double compound mechanism, while providing significantly increased power to the cutting jaws, also inhibits the opening of those jaws. In other words, due to the presence of a second compound linkage, the jaws cannot be fully opened. In these double compound mechanisms the jaws are limited to opening less than approximately half their fully opened position.

It would be highly advantageous, therefore, to remedy the foregoing and other deficiencies inherent in the prior art.

Accordingly, it is an object of the present invention to provide a new and improved cutting tool with leverage for additional cutting power in which the jaws are capable of fully opening.

It is a further object of the present invention to provide a new and improved cutting tool with leverage for additional cutting power including first compound linkage and second compound linkage pivotally linked together to provide complete opening of the cutting jaws.

SUMMARY OF THE INVENTION

Briefly, to achieve the desired objects of the instant invention in accordance with a preferred embodiment thereof, a cutting tool with double compound leverage is provided. The cutting tool includes first and second opposed handle levers each including handle ends and pivot ends, one of the first and second levers including a double link with a rearward portion defining the handle end and a forward portion defining the pivot end. First and second opposed blade levers each include a jaw end with an inwardly directed cutting blade and a lever end. The first and second blade levers are each pivotally attached intermediate the jaw end and the lever end at spaced apart points to a transverse coupling element. The cutting blades and jaw ends define cutting jaws. One each of the pivot ends of the first and second opposed handle levers are pivotally attached to one each of the lever ends of the first and second opposed blade levers. First compound linkage and second compound linkage pivotally couple the first and second opposed handle levers and the first and second opposed blade levers so as to provide complete opening and closing of the cutting jaws.

In a specific embodiment of the present invention, a cutting tool with double compound leverage capable of completely opening and closing is provided. The cutting tool includes a first handle lever including a handle end and a pivot end and a second handle lever including a double link with a rearward portion defining a handle end and a forward portion defining a pivot end. First and second opposed blade levers each include a jaw end with an inwardly directed cutting blade and a lever end. The first and second blade levers are each pivotally attached intermediate the jaw end and the lever end at spaced apart points to a transverse coupling element, the cutting blades and jaw ends defining cutting jaws. The pivot end of the first opposed handle lever is pivotally attached to the lever end of the first opposed blade lever defining a first pivot element. The pivot end of the second opposed handle lever is pivotally attached to the lever end of the second opposed blade lever defining a second pivot element. First compound linkage pivotally couples the first pivot element and the second pivot element to a third pivot element. Second compound linkage pivotally couples the first and second opposed handle levers to the third pivot element and the forward portion of the second handle lever to the rearward portion. The second compound linkage includes at least one movable pivot element formed by a pivot movable within a longitudinally extending slot and pivotally coupling one of the first and second opposed handle levers to the second compound linkage. The second compound linkage is formed so that the at least one pivot movable within the longitudinally extending slot is positioned adjacent a rear end of the slot when the cutting jaws are closed and adjacent a front end of the slot when the cutting jaws are completely open.

BRIEF DESCRIPTION OF THE DRAWINGS

Specific objects and advantages of the invention will become readily apparent to those skilled in the art from the following detailed description of a preferred embodiment thereof, taken in conjunction with the drawings in which.

DETAILED DESCRIPTION OF A PREFERRED EMBODIMENT

Figure 1:
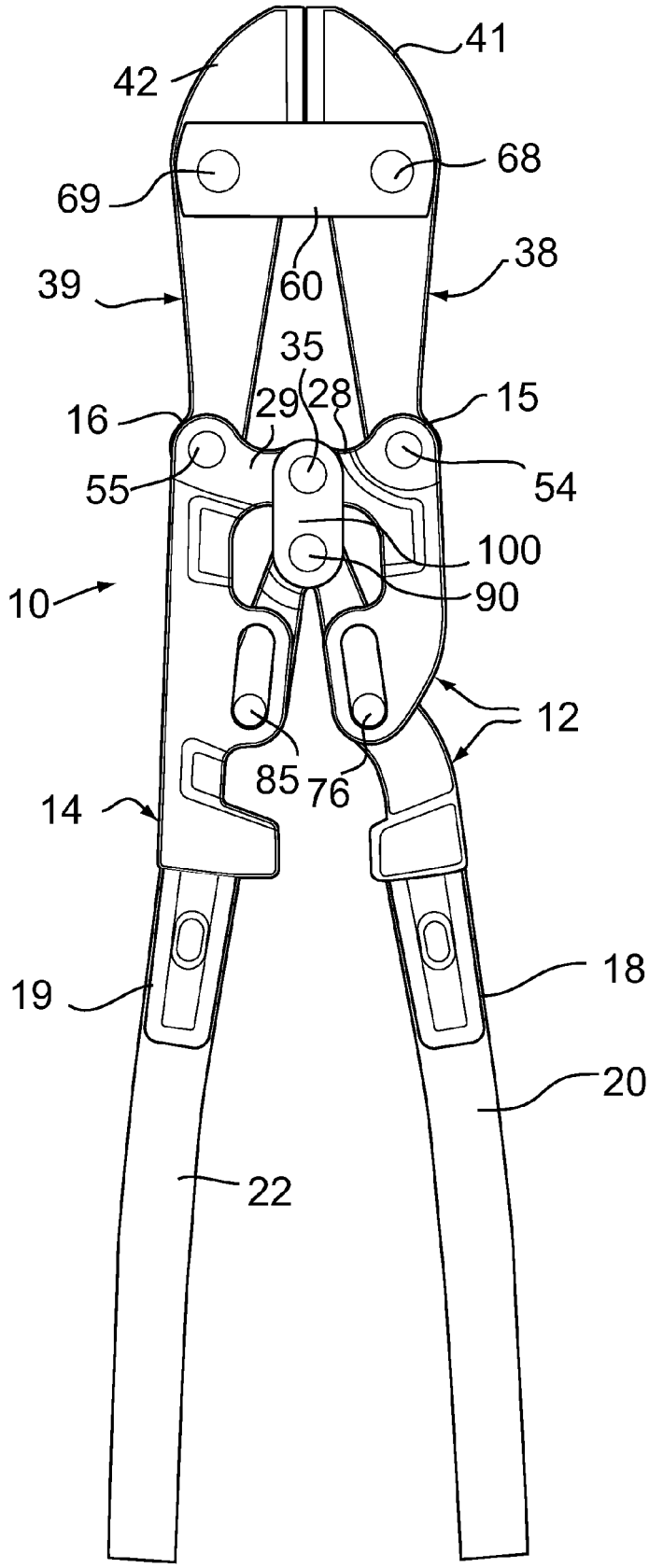
FIG. 1 is top plan view of a cutting tool with double compound leverage, in the closed/cutting position, according to the present invention.
Figure 2:
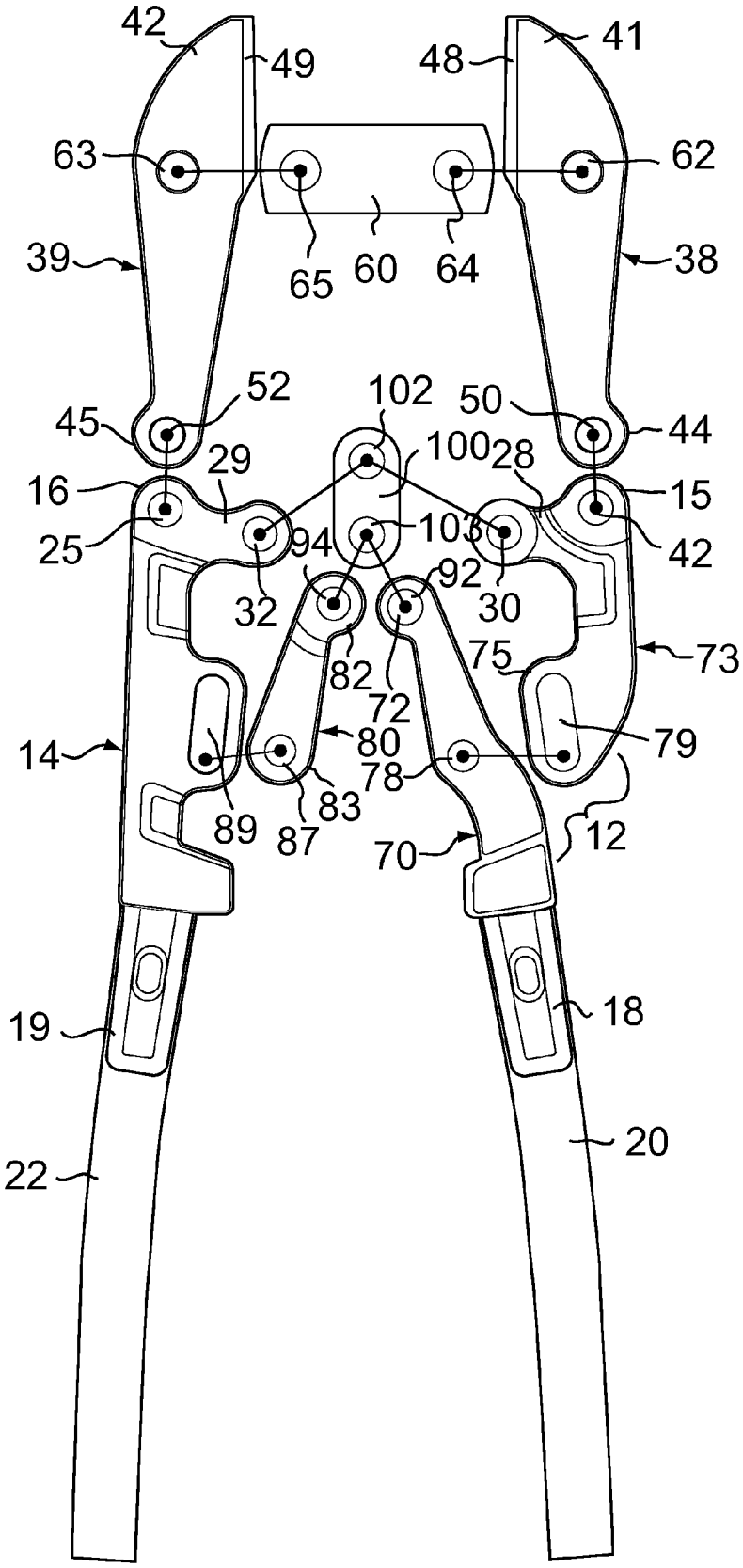
FIG. 2 is an exploded top view of the cutting tool of FIG. 1.

Turning now to the drawings, attention is directed to FIGS. 1 and 2 which illustrate a cutting tool generally designate 10. Cutting tool 10 has a double compound leverage mechanism which greatly increases the cutting force applied by an individual utilizing the tool. For purposes of orientation in the description of the present invention, forward is a direction toward the cutting end of the tool, and rearward is a direction toward the handle end of the tool. Additionally, inward or inwardly is a direction toward a center line of the tool extending between the cutting end and the handle end, and outward or outwardly is away from the center line. Double compound cutting tools are known in the art, such as those disclosed in U.S. Pat. No. 7,346,991, and U.S. Pat. No. 7,444,851 incorporated by reference herein.

Cutting tool 10 includes a pair of opposing handle levers 12 and 14, each having a pivot end 15, 16 and a handle end 18, 19, respectively. Here it should be noted that handle lever 14 extends in a continuous piece from handle end 19 to pivot end 16 but handle lever 12 is formed of a double link, including a rearward portion 70 having handle end 18 and forward portion 72, and a forward portion 73 having a pivot end 15, and a rearward end 75. Handle lever 12 and the coupling of the double link are explained in more detail below. Suitable handles 20, 22 are attached to handle ends 18, 19. While handles are attached to handle levers 18, 19 in this preferred embodiment, it will be understood that the handle levers themselves can be extended to serve as handles if desired.

Figure 3:
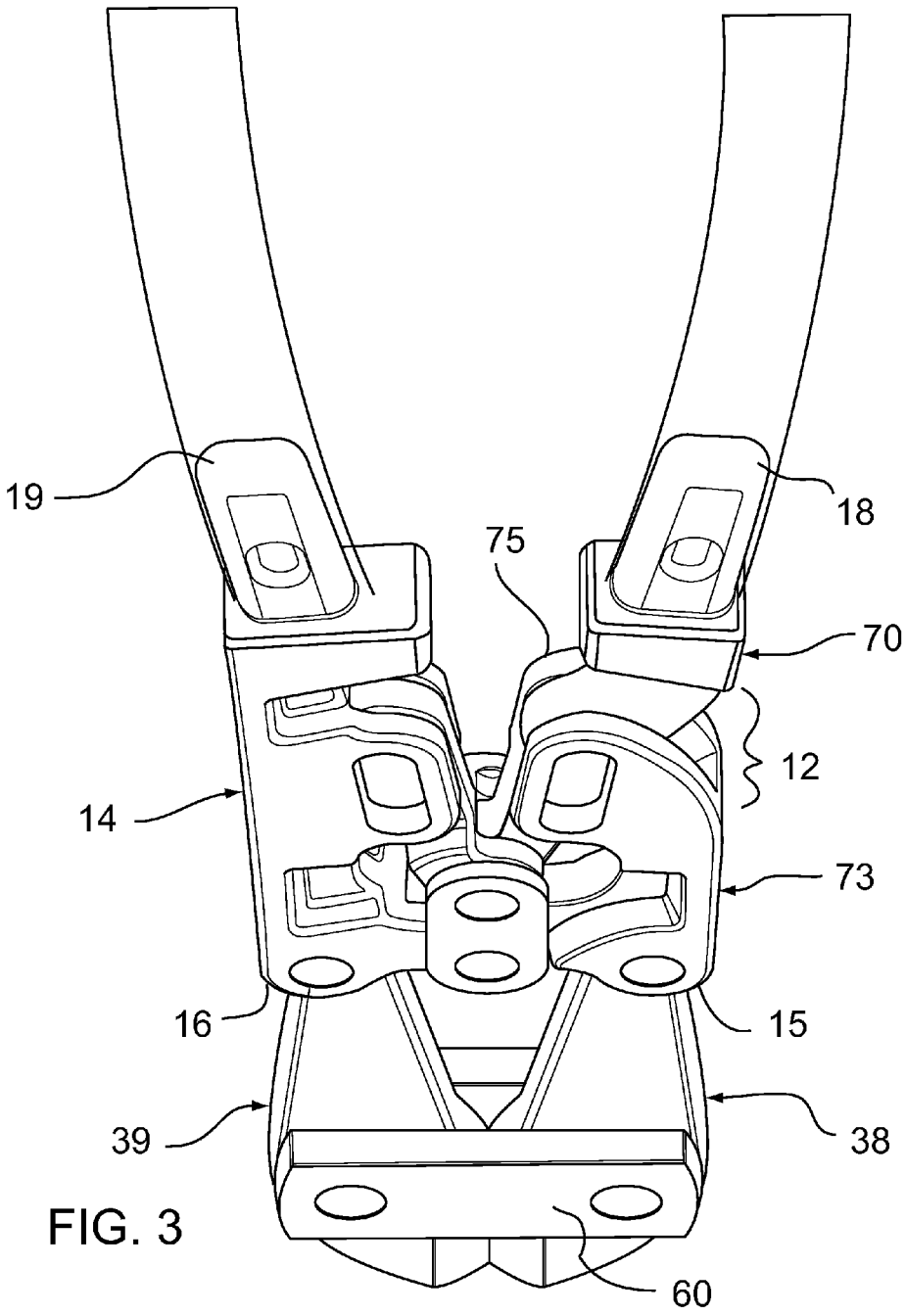
FIG. 3 is an isometric view of the cutting tool of FIGS. 1 and 2.

In this embodiment, pivot ends 15, 16 are bifurcated or laterally slotted, as can be seen with additional reference to FIG. 3, with apertures 24, 25 extending therethrough. Pivot ends 15, 16 also each include an inwardly directed extension 28, 29 through which apertures 30, 32 extend. Extensions 28 and 29 overlap with apertures 30 and 32 aligning and receiving a pivot pin to form a pivot element 35. It will be understood by those of ordinary skill in the art that pivot element 35 can be formed in different well known manners, such as using nuts and bolts, pivot pins, rivets, and the like. It will be further understood that this holds true for each of the pivots in the following description.

Blade levers 38, 39 each include a jaw end 41, 42 and a lever end 44, 45, respectively. Jaw ends 41, 42 each include an inwardly directed cutting blade 48, 49, respectively, which are movable between an open position and a closed or cutting position as illustrated. Pivot ends 15, 16 are pivotally coupled to blade levers 38, 39 at lever ends 44, 45, respectively. Lever ends 44, 45 each have an aperture 50, 52 therethrough. Lever ends 44, 45 are positioned within the bifurcation or lateral slot of pivot ends 15, 16, with apertures 50, 52 aligned with apertures 24, 25, respectively. Coupling members such as bolts, pins or the like, extend concurrently through apertures 24, 50 and 25 52 to form pivot elements 54 and 55, respectively. Pivot elements 54 and 55 couple handle levers 12, 14 with blade levers 38, 39, and permit pivoting movement therebetween. As can be seen in FIG. 1, pivot element 35 is positioned rearwardly of pivots 54 and 55. Extensions 28 and 29 form a first compound linkage between pivot elements 35, 54, and 55.

A transverse coupling element 60, such as plate or plates (e.g. upper and lower plates), is pivotally coupled to and extends between blade levers 38, 39 intermediate jaw ends 41, 42 and lever ends 44, 45. Pins inserted concurrently through apertures 62, 63 formed in blade levers 38, 39 and apertures 64, 65 formed through coupling element 60 is employed, in this preferred embodiment, to form pivots 68 and 69 pivotally coupling element 60 to each of blade levers 38, 39. Thus, in operation, as handle end 18, 19 of handle levers 12, 14 are moved outwardly (away from each other), pivot ends 15, 16 move toward one another about pivot 35 and lever ends 44, 45 move inwardly toward each other rotating about pivots 54, 55. Blade levers 38, 39 pivot about pivots 68, 69, opening jaw ends 41, 42. Jaw ends 41, 42 are closed in a reverse operation.

Figure 4:
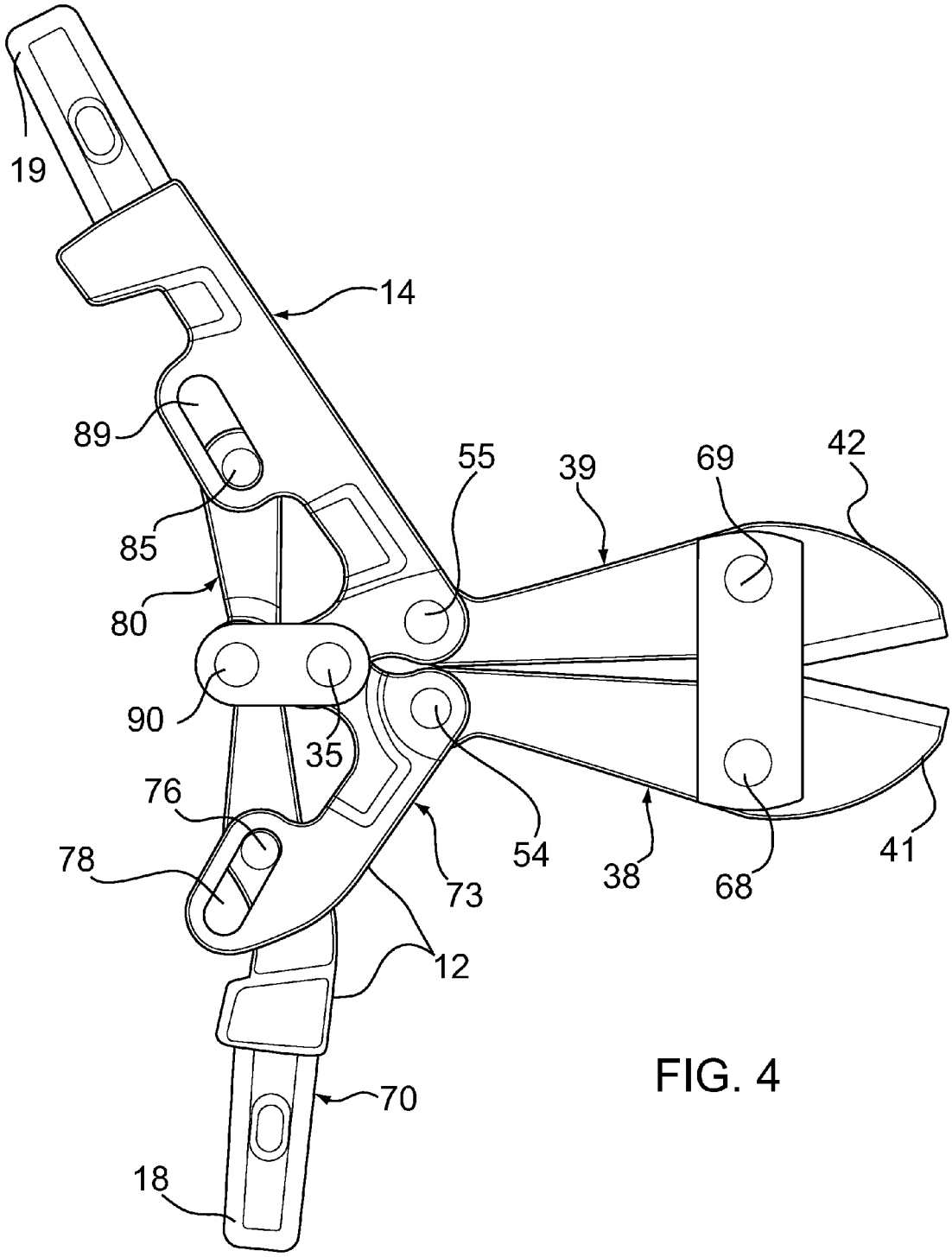
FIG. 4 is a top plan view of the cutting tool of FIG. 1 in an open position.

A second compound linkage is formed rearward of the first compound linkage (i.e. extensions 28 and 29). This second compound linkage acts in concert with the first compound linkage, increasing the power applied at jaw ends 41, 42. Previous attempts at forming double compound cutting tools having transverse coupling (e.g. element 60) forming separate pivots points 68, 69 of blade levers 38, 39 have had operating problems. Specifically, the double compound mechanism, while providing significantly increased power to the cutting jaws, also inhibits the opening of those jaws. In other words, due to the presence of a second compound linkage, jaws 41, 42 cannot be fully opened. The jaws are limited to opening less than approximately half their fully opened position. In the present invention, fully opened is defined by pivot element 54 and pivot element 55 moving inwardly toward one another until the components come into contact, preventing further movement (as illustrated in FIG. 4).

In this embodiment, handle lever 12 is formed of a double link, including rearward portion 70 having handle end 18 and forward end 72, and forward portion 73 having pivot end 15, and a rearward end 75. Forward portion 73 is pivotally coupled to rearward portion 70 by a movable pivot element 76 formed by a pin extending concurrently through an aperture 78 formed in rearward portion 70 intermediate forward end 72 and handle end 18, and a slot 79 formed in forward portion 73 proximate rearward end 75. A link 80 having a forward end 82 and a rearward end 83 is pivotally coupled to handle lever 14 intermediate handle end 19 and pivot end 16. Link 80 is pivotally coupled to handle lever 14 by a movable pivot element 85 formed by a pin extending concurrently through an aperture 87 formed in rearward end 83 and a slot 89 formed in handle lever 14 intermediate handle end 19 and pivot end 16. The second compound linkage is completed by a pivot element 90 formed by a pin extending concurrently through an aperture 92 formed in forward end 72 of rearward portion 70 and an aperture 94 formed in forward end 82 of link 80. The second compound linkage is formed of pivot elements 76, 85, and 90. It is the presence of pivots riding in slots 79, 89 which permit jaws 41, 42 to be fully opened. In the closed position, the pivots are positioned toward a rearward end of slots 79, 89, respectively. In the open position, as shown in FIG. 4, jaws 41, 42 are fully opened, permitted by the movement of the pivots toward a forward end of slots 79, 89. It will be understood that the pivots freely move within slots 79, 89 and do not engage either forward or rearward ends thereof. Also, it will be understood that pivot elements 76 and 85, in this preferred embodiment, include slots 79 and 89 and the pivots movable therein.

In one construction of the present invention, the first compound linkage (i.e. extensions 28 and 29 and pivot element 35) and the second compound linkage (i.e. pivot elements 76, 85, and 90 and their associated links) are coupled at pivot elements 35 and 90 by a tie link 100 having a forward end and a rearward end. Tie link 100 includes aperture 102 which aligns with apertures 30, 32 and aperture 103 which aligns with apertures 92, 94. Tie link 100 facilitates opening jaws 41, 42 to the fully opened position enhanced by slots 79, 89. Tie 100 eases opening jaws 41, 42 to the fully opened position by the interaction between the second compound linkage with the first compound linkage. Movement of the second compound linkage pulls tie link 100 rearwardly, which in turn pulls the first compound linkage to the fully open position.

As can be seen with reference to FIG. 3, forward ends 15, 16, rearward end 75, intermediate portion of handle lever 14 through which slot 89 is formed, forward end 82, and extension 29, are bifurcated or laterally slotted to provide a strong stabilized pivot coupling. It will be understood that while these bifurcations are employed in the preferred embodiment, non-bifurcated ends can also be pivotally coupled.

Figure 5:
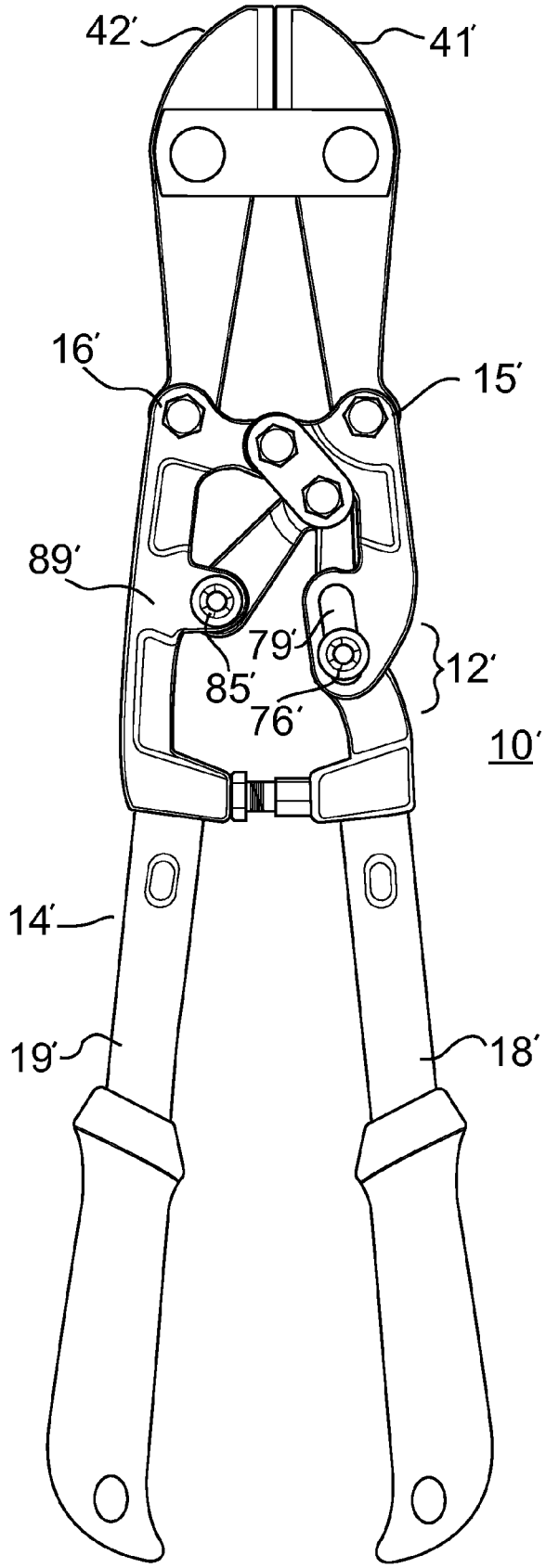
FIG. 5 is top plan view of a modified cutting tool with double compound leverage, in the closed/cutting position, according to the present invention.
Figure 6:
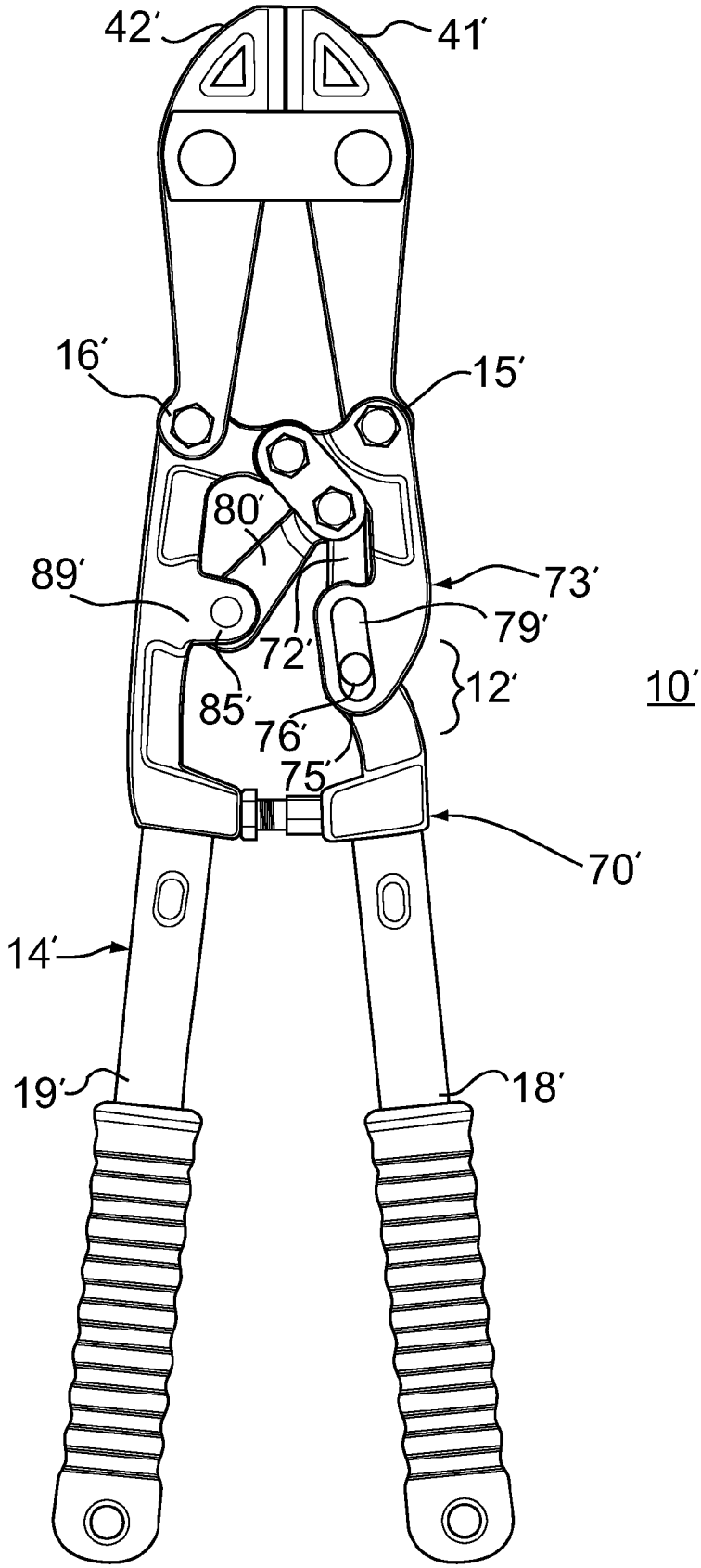
FIG. 6 is a top plan view of the cutting tool of FIG. 5 illustrating the various components in detail.

Turning now to FIGS. 5 and 6, a modified cutting tool 10' with double compound leverage (shown in the closed/cutting position) is illustrated in accordance with the present invention. The various components of cutting tool 10' that are similar to cutting tool 10 above are designated with similar numbers having a prime (') added to indicate the different embodiment. Also, components that perform the same function as those described above will not be elaborated upon but differences in construction or operation are described in detail.

In this embodiment, handle lever 12' is formed of a double link, including rearward portion 70' having handle end 18' and forward end 72', and forward portion 73' having pivot end 15', and a rearward end 75'. Forward portion 73' is pivotally coupled to rearward portion 70' by a movable pivot element 76' formed by a pin extending concurrently through an aperture formed in rearward portion 70' intermediate forward end 72' and handle end 18', and a slot 79' formed in forward portion 73' proximate rearward end 75'. A link 80' having a forward end and a rearward end is pivotally coupled to handle lever 14' intermediate handle end 19' and pivot end 16'. Link 80' is pivotally coupled to handle lever 14' by a fixed pivot element 85' formed by a pin extending concurrently through an aperture formed in the rearward end and a bracket 89' formed on handle lever 14' intermediate handle end 19' and pivot end 16'. Thus, in this embodiment only one movable pivot element is provided and the opposed pivot element is fixed. In the open position, not shown, jaws 41', 42' can be fully opened, permitted by the movement of the single pivot toward a forward end of slot 79'. It will be understood that the pivot freely moves within slot 79' and does not engage either forward or rearward ends thereof (generally as described above). Also, it will be understood that movable pivot element 76', in this embodiment, includes slot 79' and the pivot movable therein. Including only one movable pivot element and connecting the opposed side by a solid bracket results in the handles being closer together in the open mode which gives a better reach, which greatly increases cutting power.

Referring further to both of the above described structures it should be understood that in a preferred embodiment the pin 76' of the single movable pivot element or the two pins 76 and 85 of the double movable pivot elements are roller pins that rotate within slots 79' or slots 79 and 89, respectively. Here it should be understood that a roller pin is a pin that freely rotates about the longitudinal axis (the vertical axis in FIGS. 5 and 6) of the pin. By providing roller pins within the elongated slots the elements are freer to move relative to each other and friction is substantially reduced. Further, because friction is reduced, the cutting power is substantially increased.

Thus, a new and improved cutting tool with double compound leverage for additional cutting power is provided in which the jaws are capable of fully opening. In the present invention the new and improved cutting tool with double compound leverage for additional cutting includes first compound linkage and second compound linkage pivotally linked together to provide complete opening of the cutting jaws.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. A cutting tool with double compound leverage comprising:

first and second opposed handle levers each including a handle end and a pivot end, one of the first and second handle levers including a double link with a rearward portion defining the handle end and pivotally coupled to a forward portion defining the pivot end;

first and second opposed blade levers each including a jaw end with an inwardly directed cutting blade and a lever end, the first and second blade levers each being pivotally attached intermediate the jaw end and the lever end at spaced apart points to a transverse coupling element, the cutting blades and the jaw ends defining cutting jaws;

one each of the pivot ends of the first and second opposed handle levers pivotally attached to one each of the lever ends of the first and second opposed blade levers;

a first compound linkage and a second compound linkage pivotally coupling the first and second opposed handle levers and the blade levers so as to provide complete opening and closing of the cutting jaws; and wherein the second compound linkage includes at least one movable pivot element formed by a pivot movable within a longitudinally extending slot and pivotally coupling one of the first and second opposed handle levers to the second compound linkage.

2. A cutting tool with double compound leverage as claimed in claim 1 wherein the second compound linkage includes a pivot element pivotally coupling the rearward portion and the forward portion of the one of the first and second handle levers.

3. A cutting tool with double compound leverage as claimed in claim 1 wherein the at least one movable pivot element movable within the longitudinally extending slot includes a roller pin.

4. A cutting tool with double compound leverage as claimed in claim 1 wherein the second compound linkage includes two movable pivot elements each formed by a pivot movable within a longitudinally extending slot and pivotally coupling each of the first and second opposed handle levers to the second compound linkage.

5. A cutting tool with double compound leverage as claimed in claim 4 wherein the pivot movable within the longitudinally extending slot of each of the two movable pivot elements includes a roller pin.

6. A cutting tool with double compound leverage as claimed in claim 4 wherein the second compound linkage is formed so that the pivots movable within the longitudinally extending slots are positioned adjacent a rear end of the slots when the cutting jaws are closed and adjacent a front end of the slots when the cutting jaws are completely open.

7. A cutting tool with double compound leverage as claimed in claim 1 wherein the transverse coupling element includes at least one elongated plate with openings adjacent opposed ends, one each of the openings being pivotally attached intermediate the jaw end and the lever end of one each of the first and second opposed blade levers.

8. A cutting tool with double compound leverage as claimed in claim 1 wherein the pivot end of the first opposed handle lever is pivotally attached to the lever end of the first opposed blade lever defining a first pivot element and the pivot end of the second opposed handle lever is pivotally attached to the lever end of the second opposed blade lever defining a second pivot element, the first compound linkage pivotally coupling the first pivot element and the second pivot element.

9. A cutting tool with double compound leverage as claimed in claim 8 wherein the first compound linkage pivotally coupling the first pivot element and the second pivot element defines a third pivot element, the second compound linkage pivotally couples the first and second opposed handle levers to the third pivot element.

10. A cutting tool with double compound leverage as claimed in claim 9 wherein the second compound linkage includes movable pivot elements pivotally coupling the first and second opposed handle levers to the second compound linkage.

11. A cutting tool with double compound leverage as claimed in claim 10 wherein the movable pivot elements have a first position defining a completely open orientation for the cutting jaws and a second position defining a closed or cutting orientation for the cutting jaws.

12. A cutting tool with double compound leverage comprising:

first and second opposed handle levers each including a handle end and a pivot end, one of the first and second handle levers including a double link with a rearward portion defining the handle end and pivotally coupled to a forward portion defining the pivot end;

first and second opposed blade levers each including a jaw end with an inwardly directed cutting blade and a lever end, the first and second blade levers each being pivotally attached intermediate the jaw end and the lever end at spaced apart points to a transverse coupling element, the cutting blades and the jaw ends defining cutting jaws;

one each of the pivot ends of the first and second opposed handle levers pivotally attached to one each of the lever ends of the first and second opposed blade levers;

a first compound linkage and a second compound linkage pivotally coupling the first and second opposed handle levers and the blade levers so as to provide complete opening and closing of the cutting jaws; and wherein the first compound linkage and the second compound linkage are coupled by a tie link having a forward end and a rearward end, with the forward end of the tie link pivotally attached to the first compound linkage and the rearward end of the tie link pivotally attached to the second compound linkage.

13. A cutting tool with double compound leverage comprising:

first and second opposed handle levers each including a handle end and a pivot end, one of the first and second handle levers including a double link with a rearward portion defining the handle end and pivotally coupled to a forward portion defining the pivot end;

first and second opposed blade levers each including a jaw end with an inwardly directed cutting blade and a lever end, the first and second blade levers each being pivotally attached intermediate the jaw end and the lever end at spaced apart pivot points to a transverse coupling element, the cutting blades and the jaw ends defining cutting jaws;

the pivot end of the first opposed handle lever pivotally attached to the lever end of the first opposed blade lever defining a first pivot element;

the pivot end of the second opposed handle lever pivotally attached to the lever end of the second opposed blade lever defining a second pivot element;

a first compound linkage pivotally coupling the first pivot element and the second pivot element to a third pivot element;

a second compound linkage pivotally coupling the first and second opposed handle levers to the third pivot element so that the cutting jaws are moved into a closed cutting position with movement of the first and second opposed handle levers into a closed orientation and the cutting jaws are moved into a completely opened position with movement of the first and second opposed handle levers into an open.

14. A cutting tool with double compound leverage as claimed in claim 13 wherein at least a portion of the second compound linkage pivotally couples the double link of the one of the first and second handle levers.

15. A cutting tool with double compound leverage as claimed in claim 13 wherein the first compound linkage is formed so that portions of the first pivot element and the second pivot element come into contact when the cutting jaws are moved into the completely opened position.

16. A cutting tool with double compound leverage as claimed in claim 13 wherein the second compound linkage includes at least one movable pivot element pivotally coupling one of the first and second opposed handle levers to the second compound linkage.

17. A cutting tool with double compound leverage as claimed in claim 16 wherein the at least one movable pivot element includes a pivot movable within a longitudinally extending slot and the pivot includes a roller pin.

18. A cutting tool with double compound leverage as claimed in claim 16 wherein the at least one movable pivot element has a first position defining a completely open orientation for the cutting jaws and a second position defining a closed or cutting orientation for the cutting jaws.

19. A cutting tool with double compound leverage as claimed in claim 13 wherein the second compound linkage includes two movable pivot elements each formed by a pivot movable within a longitudinally extending slot and pivotally coupling each of the first and second opposed handle levers to the second compound linkage.

20. A cutting tool with double compound leverage as claimed in claim 19 wherein the pivot movable within the longitudinally extending slot of each of the two movable pivot elements includes a roller pin.

21. A cutting tool with double compound leverage as claimed in claim 19 wherein the second compound linkage is formed so that the pivots movable within the longitudinally extending slots are positioned adjacent a rear end of the slots when the cutting jaws are closed and adjacent a front end of the slots when the cutting jaws are completely open.

22. A cutting tool with double compound leverage comprising:

a first handle lever including a handle end and a pivot end and a second handle lever including a double link with a rearward portion defining a handle end and a forward portion defining a pivot end;

first and second opposed blade levers each including a jaw end with an inwardly directed cutting blade and a lever end, the first and second blade levers each being pivotally attached intermediate the jaw end and the lever end at spaced apart pivot points to a transverse coupling element, the cutting blades and the jaw ends defining cutting jaws;

the pivot end of the first opposed handle lever pivotally attached to the lever end of the first opposed blade lever defining a first pivot element;

the pivot end of the second opposed handle lever pivotally attached to the lever end of the second opposed blade lever defining a second pivot element;

a first compound linkage pivotally coupling the first pivot element and the second pivot element to a third pivot element; and a second compound linkage pivotally coupling the first and second opposed handle levers to the third pivot element and the forward portion of the second handle lever to the rearward portion, the second compound linkage including at least one movable pivot element formed by a pivot movable within a longitudinally extending slot and pivotally coupling one of the first and second opposed handle levers to the second compound linkage, and the second compound linkage being formed so that the at least one pivot movable within the longitudinally extending slot is positioned adjacent a rear end of the slot when the cutting jaws are closed and adjacent a front end of the slot when the cutting jaws are completely open.

23. A cutting tool with double compound leverage as claimed in claim 22 wherein the at least one movable pivot element includes a roller pin.

24. A cutting tool with double compound leverage as claimed in claim 22 wherein the second compound linkage includes a tie link with the first compound linkage and the second compound linkage being pivotally coupled by the tie link, the tie link having a forward end and a rearward end with the forward end of the tie link pivotally attached to the first compound linkage at the third pivot element and the rearward end of the tie link defining a fourth pivot element pivotally attached to the two movable pivot elements of the second compound linkage.

* * * * *